US005492253A

United States Patent [19]

Proshan

[11] Patent Number: 5,492,253

[45] Date of Patent: Feb. 20, 1996

[54] CAP ATTACHMENT FOR SMALL NECK PLASTIC BOTTLE OF LIQUID

[76] Inventor: Mary-Elizabeth Proshan, Suite 194. 301 N. Harrison St., Princeton, N.J. 08540

[21] Appl. No.: 410,557

[22] Filed: Mar. 24, 1995

[51] Int. Cl.[6] ..... B65D 47/00

[52] U.S. Cl. ..... 222/547; 222/212; 222/490

[58] Field of Search ..... 222/490, 420, 222/212, 494, 568, 570, 547

[56] References Cited

U.S. PATENT DOCUMENTS

| | | | |
|---|---|---|---|
| 2,802,608 | 8/1957 | Gassaway | 222/490 |
| 3,773,233 | 11/1973 | Souza | 222/490 |
| 5,219,101 | 6/1993 | Matkovich et al. | 222/420 X |
| 5,358,151 | 10/1994 | Strasenburgh | 222/420 |
| 5,373,964 | 12/1994 | Moore | 222/420 X |
| 5,433,338 | 7/1995 | Proshan | 222/570 X |

*Primary Examiner*—Gregory L. Huson

[57] ABSTRACT

A cap utilizes a flat disc having a peripheral socket adapted to receive the open end of the neck of a small necked plastic bottle. The disc has a first narrow rectangularly elongated slot centered therein. A vertical hollow spout is integral with the disc. The spout has open upper and lower ends and has an inner wall. The spout tapers downwardly and outwardly to the disc. The lower end of the spout has an opening the same size and shape as said first slot and is coincident therewith. The upper end of the spout has a second narrow rectangularly elongated slot centered on the first slot. A flat horizontal member is disposed in the spout between the upper and lower ends and is sealed peripherally to the inner wall. The member has a third narrow rectangularly elongated slot centered on the first slot, the third slot being much narrower than either one of the first and second slots.

8 Claims, 1 Drawing Sheet

CAP ATTACHMENT FOR SMALL NECK PLASTIC BOTTLE OF LIQUID

CROSS REFERENCE TO COPENDING APPLICATION

The present invention is related to application of the same inventor which is entitled DEMOUNTABLE CAP FOR DISPOSABLE CONTAINERS OF LIQUID, filed on 10/19/94, Ser. No. 08/323,825 now U.S. Pat. No. 5,433,338.

BACKGROUND OF THE INVENTION

Disposable plastic bottles of liquid such as water, soda and the like have relatively small necks which are sealed with a removable cover prior to use. Users, once the cover is removed and the neck is open, can drink from the open neck. However, when the user is walking or running, it is difficult for the user to drink from a tilted bottle. In addition, while the user can hold the bottle in one hand for drinking, in order to prevent the bottle from leaking prior to reuse, the user must again attach the cover to the neck, an operation requiring the user to use both hands.

The present invention is directed toward a new type of bottle cap which when secured to an open small neck of a plastic bottle of liquid will enable the user to drink from a bottle by squeezing the bottle so that the liquid is ejected outward therefrom. This cap is so constructed that the liquid will not leak out of the bottle even when the bottle is tilted or held vertically as long as the bottle is not squeezed. Hence it is not necessary to remove or re-attach the cap after use.

SUMMARY OF THE INVENTION

Accordingly, it is an object of the present invention to provide a new and improved cap for a plastic bottle of liquid having a small neck which will enable a user to drink from such bottles by squeezing the bottle, thus forcing the liquid to be ejected outward therefrom.

Another object is to provide a new and improved cap of the character indicated which once secured to the open neck does not have to be removed or replaced during periods of interrupted successive use.

Yet another object is to provide a new and improved caps of the character indicated which can be manufactured easily and inexpensively.

These and other objects and advantages of the invention will either be explained or will become apparent hereinafter.

In accordance with the principles of this invention, a cap adapted for engagement with the open end of a small neck of a plastic bottle of liquid, is provided with a flat disc having a peripheral socket in which the open end can be inserted and held therein in a leakproof manner. A first narrow rectangularly elongated slot is centered in the disc.

A vertical hollow spout is integral with the disc. The spout has open upper and lower ends and has an inner wall. The spout tapers downwardly and outwardly to the disc. The lower end of the spout has an opening the same size and shape as said first slot which is coincident therewith. The upper end of the spout has a second narrow rectangularly elongated slot centered on the first slot.

A flat horizontal member is disposed in the spout between the upper and lower ends and is sealed peripherally to the inner wall. The member has a third narrow rectangularly elongated slot centered on the first slot. The third slot is much narrower than either one of the first and second slots.

Once the cap is secured to the open end of the neck of the bottle, a user can drink therefrom by squeezing the bottle, the liquid being ejected outwardly therefrom as previously described.

DETAILED DESCRIPTION OF PREFERRED EMBODIMENTS

Referring to FIGS. 1–7, a plastic cap has a flat horizontal circular disc 10 having a diameter somewhat larger than the outer diameter of the small open neck 12 of a plastic bottle 14 containing liquid such as water. The disc has a first narrow rectangularly elongated slot 22 centered therein.

Figure 1:
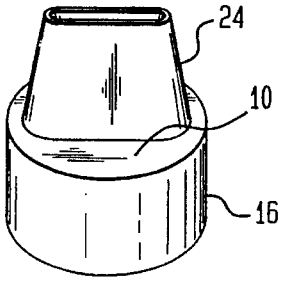
FIG. 1 is a top perspective view of a cap in accordance with the invention.
Figure 7:
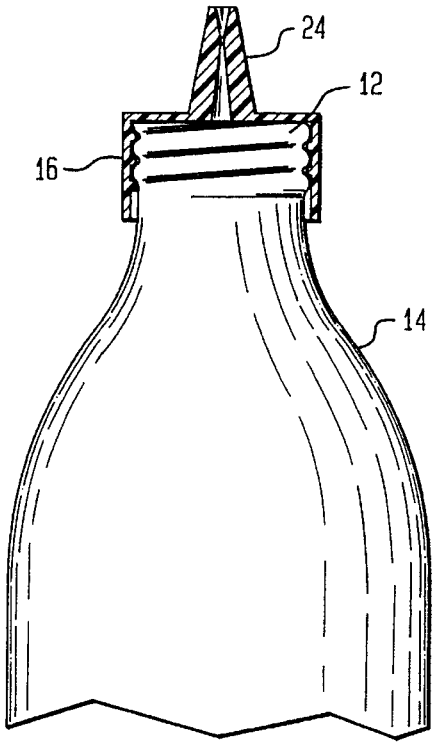
FIG. 7 is a side view, partially in cross section, of the cap as secured to a plastic bottle containing liquid.
Figure 2:
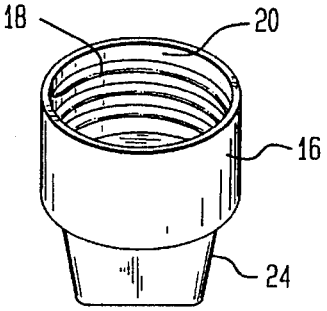
FIG. 2 is a bottom perspective view thereof.
Figure 3:
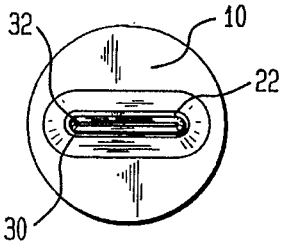
FIG. 3 is a top plan view thereof.
Figure 4:
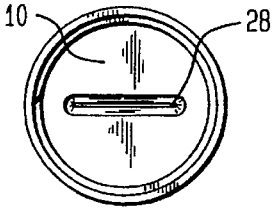
FIG. 4 is a bottom plan view thereof.
Figure 5:
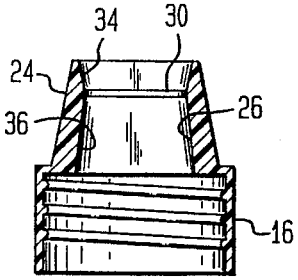
FIG. 5 is a vertical cross section thereof as taken in a longitudinal direction through the spout.
Figure 6:
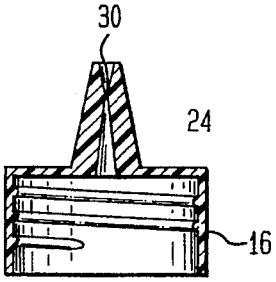
FIG. 6 is a vertical cross section thereof as taken in a lateral direction through the spout.

The disc has an integral peripherally secured socket 16 in the form of a vertical circular cylinder open at its lower end. The cylinder has threads 18 or the like in its inner wall 20. The socket is adapted to receive and hold the open end of the neck, as for example by being threadly engaged thereto as illustrated in FIG. 7. Other engagement means can be used.

A vertical hollow spout 24 is integral with the disc. The spout has open upper and lower ends and having an inner wall. The spout tapers downwardly and outwardly to the disc. The height of the spout above the disc is essentially equal to the length of the socket. Typically, each of these distances is about ⅝ inches. The lower end of the spout has an opening 26 of the same size and shape as said first slot 22 and is coincident therewith. The upper end of the spout has a second narrow rectangularly elongated slot 28 centered on the first slot. Slots 22 and 28 are approximately of the same shape and size. Each of these slots typically are about ⅝ inch long and 3/16 inch wide.

A flat horizontal member 30 is disposed in the spout between the upper and lower ends and is sealed peripherally to the inner wall. The member has a third narrow rectangularly elongated slot 32 centered on the first slot, the third slot being much narrower and somewhat shorter than either one of the first and second slots. The area of slot 32 is much smaller than the area of either one of slots 22 and 28, typically being about 9/16 inch long and 1/32 inch wide.

The inner wall of the spout tapers downwardly and inwardly from the second slot to the third slot as shown at 34 and tapers downwardly and outwardly from the third slot to the first slot as shown at 36. While the member can be disposed at any position between the ends of the spout, best results are obtained when the member is positioned close to the top end of the spout, typically about half way between the tip end and the midpoint of the inner wall.

While the invention has been described with particular reference to the preferred embodiment and the drawings, the protection sought is to be limited only the terms of the claims which follow.

What is claimed is:

1. A cap adapted for engagement with the open end of a small neck of a plastic bottle of liquid, said cap comprising:

a (flat) horizontal disc having flat parallel upper and lower surfaces, said disc having a peripheral socket in which said open end can be inserted and held therein, said disc having a first narrow rectangularly elongated slot therein;

a vertical hollow spout integral with the disc, the spout having open upper and lower ends and having an inner wall, the spout tapering downwardly and outwardly to the disc, the lower end of the spout having an opening the same size and shape as said first slot and being coincident therewith, the upper end of the spout having a second narrow rectangularly elongated slot centered on the first slot; and a flat horizontal member parallel to said disc, said member being disposed in the spout between the upper and lower ends and sealed peripherally to the inner wall, said member having a third narrow rectangularly elongated slot centered on the first slot, the third slot being much narrower than either one of the first and second slots.

2. The cap of claim 1 wherein the socket is a vertical hollow cylinder open at its lower end.

3. The cap of claim 2 wherein the inner wall of the spout tapers downwardly and inwardly from the second slot to the third slot and tapers downwardly and outwardly from the third slot to the first slot.

4. The cap of claim 3 wherein the third slot is disposed adjacent the second slot and remotely from the first slot.

5. The spout of claim 4 wherein the depth of the socket as measured from the disc is essentially equal to the height of the spout as measured from the disc.

6. The cap of claim 5 wherein said spout is centered on the disc.

7. The spout of claim 6 wherein the neck has an outer surface with engagement means and the socket has an inner wall provided with mating engagement means.

8. In combination with a plastic bottle of liquid, the bottle having a small threaded neck with an open end:

a cap comprising:

a (flat) horizontal disc having flat parallel upper and lower surfaces, said disc having a peripheral socket in which said open end is inserted, the open end being held within the socket, the socket being a vertical hollow cylinder open at its bottom ends, the cylinder having an inner wall with means threadedly engaging said threaded neck, said disc having a first narrow rectangularly elongated slot centered therein;

a vertical hollow spout integral with the disc, the spout having open upper and lower ends and having an inner wall, the spout tapering downwardly and outwardly to the disc, the lower end of the spout having an opening the same size and shape as said first slot and being coincident therewith, the upper end of the spout having a second narrow rectangularly elongated slot centered on the first slot; and a flat horizontal member parallel to said disc, said member being disposed in the spout between the upper and lower ends and sealed peripherally to the inner wall, said member having a third narrow rectangularly elongated slot centered on the first slot, the third slot being much narrower than either one of the first and second slots.

* * * * *